US005261540A

United States Patent [19]

Sijsling

[11] Patent Number: 5,261,540

[45] Date of Patent: Nov. 16, 1993

[54] SCREENING MACHINE

[75] Inventor: Peter Sijsling, Erkrath, Fed. Rep. of Germany

[73] Assignee: F. Kurt Retsch GmbH & Co. KG, Haan, Fed. Rep. of Germany

[21] Appl. No.: 691,302

[22] Filed: Apr. 23, 1991

[30] Foreign Application Priority Data

Apr. 23, 1990 [DE] Fed. Rep. of Germany ..... 4012902

[51] Int. Cl.[5] ..... B07B 1/42

[52] U.S. Cl. ..... 209/368; 209/546

[58] Field of Search ..... 209/364, 365.1, 365.3, 209/365.4, 368, 546, 325, 326, 366; 73/579, 668; 340/683; 324/654

[56] References Cited

U.S. PATENT DOCUMENTS

| | | | |
|---|---|---|---|
| 2,730,236 | 1/1956 | Missien | 209/368 X |
| 2,946,440 | 7/1960 | Simpson | 209/366 X |
| 3,650,401 | 3/1972 | Riesbeck et al. | 209/368 X |
| 3,932,442 | 1/1976 | Salmon et al. | 209/368 X |
| 4,369,398 | 1/1983 | Lowry, Sr. | 340/683 X |

FOREIGN PATENT DOCUMENTS

| | | | |
|---|---|---|---|
| 131230 | 6/1978 | Fed. Rep. of Germany | 209/365.1 |
| 249685 | 9/1987 | Fed. Rep. of Germany | 209/364 |
| 787111 | 12/1980 | U.S.S.R. | 209/365.1 |
| 1279686 | 12/1986 | U.S.S.R. | 209/546 |
| 2229046 | 9/1990 | United Kingdom | 209/365.1 |

OTHER PUBLICATIONS

Retsch-Laboratory Sieving Machine Vibro; Printed in W. Germany 006/85.

*Primary Examiner*—David H. Bollinger
*Attorney, Agent, or Firm*—Robert W. Becker & Associates

[57] ABSTRACT

In a screening machine with a three-dimensional screening motion, a screen carrier for at least one screen plate is provided. The screen carrier is movable relative to a housing from which it is supported by springs. The screen carrier is driven by an electromagnetic drive device. The amplitude of oscillation of the screen carrier should be accurately readable, on the one hand, and, on the other hand, made adjustable for comparative tests. For this purpose, between the housing and the screen carrier an inductive displacement pickup for determining the amplitude of oscillation of the screen carrier is provided. This pickup is connected to a control unit which represents the determined amplitude of oscillation on an optical display and/or controls the electromagnet drive device to obtain a predetermined amplitude of oscillation.

4 Claims, 2 Drawing Sheets

SCREENING MACHINE

BACKGROUND OF THE INVENTION

The invention relates to a screening machine with a three-dimensional screening motion, having a carrier for at least one screen plate, wherein the screen carrier that is movably arranged relative to a housing and is driven by an electromagnet is supported at the housing by spring means.

A screening machine of this type is described in the company brochure "Retsch-Labor Siebmaschine, Vibro, 006/1985" (Retsch-Laboratory Screening machine, Vibro, 006/1985). In this screening machine the screen carrier includes a three-armed spider with its spider arms being supported on springs arranged at the housing so that it is movable relative to the housing. The springs, in a tangential path, are arranged in an inclined position relative to the vertical axis of the screening machine. An electromagnet arranged below the screen carrier, generates, by acting on the spider of the screen carrier, a vertical amplitude of oscillation and this vertical motion of the screen carrier is converted via the motion along the axis of the inclined springs into a three-dimensional motion of the screen plates carried by the screen carrier.

The accuracy of a grain size analysis to be undertaken with a screening machine of the aforementioned kind is determined by adhering to or knowing the following parameters: correct mesh size of the screen plates according to DIN (German Industrial Standard); analysis time; frequency of the screen motion; amplitude of oscillation of the screen motion. In order to guarantee the comparability of various analyses these parameters must be defined for the analyses carried out and must be reproducible for further analyses in order to arrive at a reliable result of analysis.

However, such a screening machine disadvantageously does not meet these requirements, in particular with respect to the determination of the amplitude of oscillation. The amplitude of oscillation may only be determined by means of a scale read according to the principle of optical illusion. For this purpose a triangle extending transverse to the oscillating axis is attached to the screen carrier, the sides of which, when the screen machine is in operation, apparently converge at one point. This point, on a correspondingly determined scale, should correspond to the dimensions of the amplitude of oscillation to be detected. It will be understood that this type of determining the amplitude of oscillation must be insufficient with regard to its accuracy, because the optical reading of a measuring point is dependent on the observation and the assessment of the operator. A further disadvantage is that with various assemblies of screen plates in the screening machine, a desired or previously adjustable amplitude of oscillation for each assembly is only obtainable by manually readjusting the driving energy of the electromagnet, but accordingly the desired measuring point cannot be adjusted with the desired accuracy due to the manual regulation of the electromagnetic drive device.

The object of the present invention is therefore to improve the screening machine of the aforementioned kind, so that the amplitude of oscillation during an analysis procedure may be read with sufficient accuracy. A further aspect of the present invention is that a certain or predetermined amplitude of oscillation may be obtained during operation of the screening machine, irrespective of the selected assembly of screen plates in the screening machine.

SUMMARY OF THE INVENTION

According to the present invention a screening machine with a three-dimensional screening motion is provided, comprising: a screen carrier for at least one screen plate, whereby the screen carrier that is movable relative to a housing is supported by resilient means at the housing; an electromagnetic drive device for moving the screen carrier; an inductive displacement pickup between the housing and the screen carrier for determining the amplitude of oscillation of the screen carrier; and a control unit connected to the pickup for representing the determined amplitude of oscillation at an optical display and/or for controlling the electromagnetic drive device for obtaining a desired amplitude of oscillation.

Thus the invention proceeds from the fundamental concept that arranged between the housing and the screen carrier an inductive displacement pickup for detecting the amplitude of oscillation of the screen carrier is provided, that is connected to a control unit which has an optical display for the representation of the established amplitude of oscillation and/or controls the required energy supply for the electromagnet drive device with respect to a given amplitude of oscillation. The advantage is that the amplitude of oscillation is measured physically accurately and is, by way of the correspondingly adjusted control unit, transformed into a readable representation, which may be directly read without requiring a subjectively influenced judgement of the measuring point by the operator. A further advantage results from the fact that the amplitude of oscillation can be predetermined, whereby the control unit in cooperation with the inductive displacement pickup controls the supply of energy required for the excitation of the drive electromagnet such that the predetermined amplitude of oscillation is accurately obtained. It is of particular advantage that this adjustment or input of an amplitude of oscillation can occur without consideration of the assembly of screen plates in the screening machine, since due to the greater weight of a larger assembly the driving energy for the motion of the screen carrier is still controlled until the predetermined amplitude of oscillation corresponds to the actual value measured by the inductive displacement pickup in each case.

With a preferred exemplary embodiment a restraint guide, which is free from play, is provided for the screen carrier. With the restraint guide the motion of the screen carrier is controlled relative to the housing via the oscillatory path of the screen carrier. The advantage is that the vertical component of the three-dimensional screening motion is accurately defined as a gauge for the amplitude of oscillation to be determined and therefore may also be measured exactly via the inductive displacement pickup. Falsifications of the vertical oscillating component of the screening motion through overlapping oscillations within the three-dimensional screening motion, due to the effects of the spring guide, are thus avoided.

According to a preferred exemplary embodiment of the invention the screen carrier is guided along a bolt arrangement, that is clamped fast with the housing and extends in the direction of the spring path, via a form-locking sliding guide, which is preferably a spherical roller sleeve arrangement, connected to the screen carrier and embracing the bolt arrangement.

BRIEF DESCRIPTION OF THE DRAWINGS

This object, and other objects and advantages of the present invention, will appear more clearly from the following specification in conjunction with the accompanying drawings, in which.

DESCRIPTION OF PREFERRED EMBODIMENTS

Figure 1:
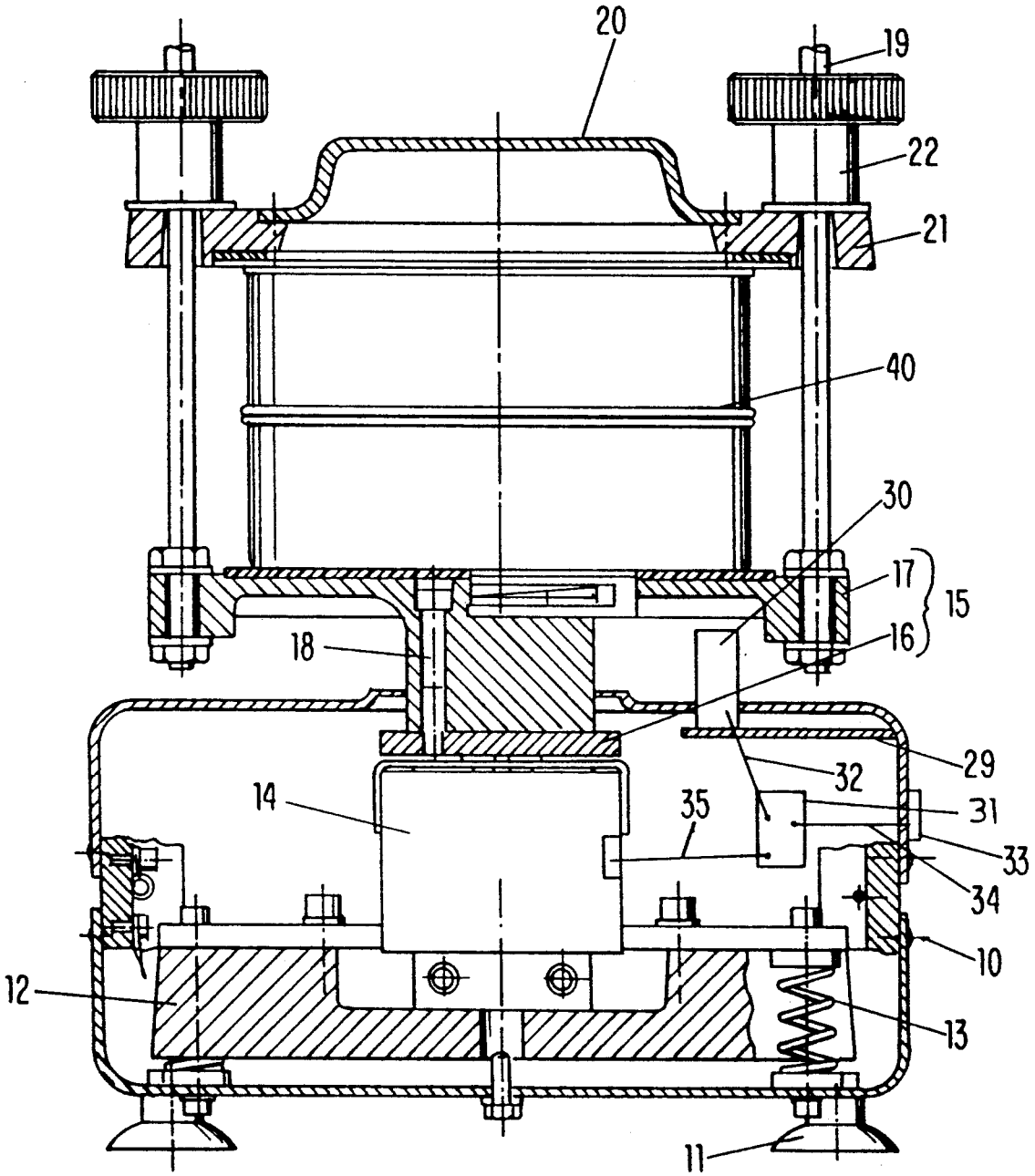
FIG. 1 is a sectional view of a screening machine.
Figure 2:
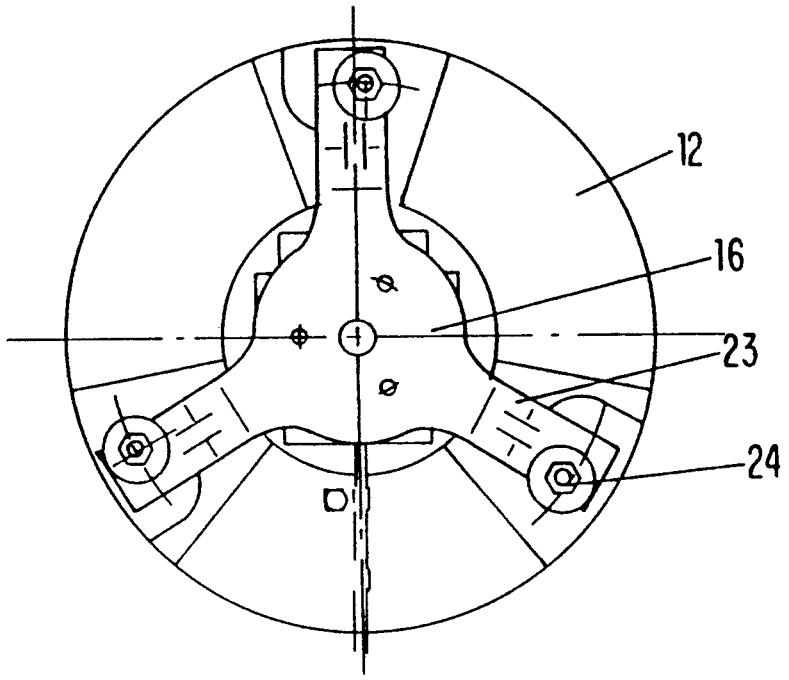
FIG. 2 is a schematic plan view of a screen carrier of the screening machine of FIG. 1.

Referring to the FIGS., arranged in a housing 10 provided with feet 11, there is a base 12 that serves as the support of a drive device and a screen tower. The base 12 is supported on springs 13 in order to dampen the vibrations emanating from the drive device and/or the screen tower that would otherwise affect the housing 10. On the base 12 an electromagnet 14 is centrally positioned and serves as the drive device, which is provided with electrical energy by way of supply lines not represented.

A screen carrier 15 is furthermore disposed on the base 12 such that it is positioned above the electromagnet 14 and spaced at a distance therefrom. The screen carrier 15 consists of a spider 16 arranged in the interior of the housing 10 and of a holder 17 for screen plates 40, disposed externally above the housing and penetrating the housing. The holder 17 is connected to the spider 16 by way of a screw 18. The holder 17 carries two vertically extending guide rods 19, on which are mounted the screen plates 40 with respective openings and arranged above each other in the form of a tower. The assembly of the screen plates 40 for the screening machine is sealed by a clamping cover 20, which has openings 21 receiving the guide rods 19. On the free ends of the guide rods 19 toggles 22 are screwed in order to clamp the screen plates against each other and to the cover 20, so that during the analysis procedure a closed screen tower is provided.

Figure 3:
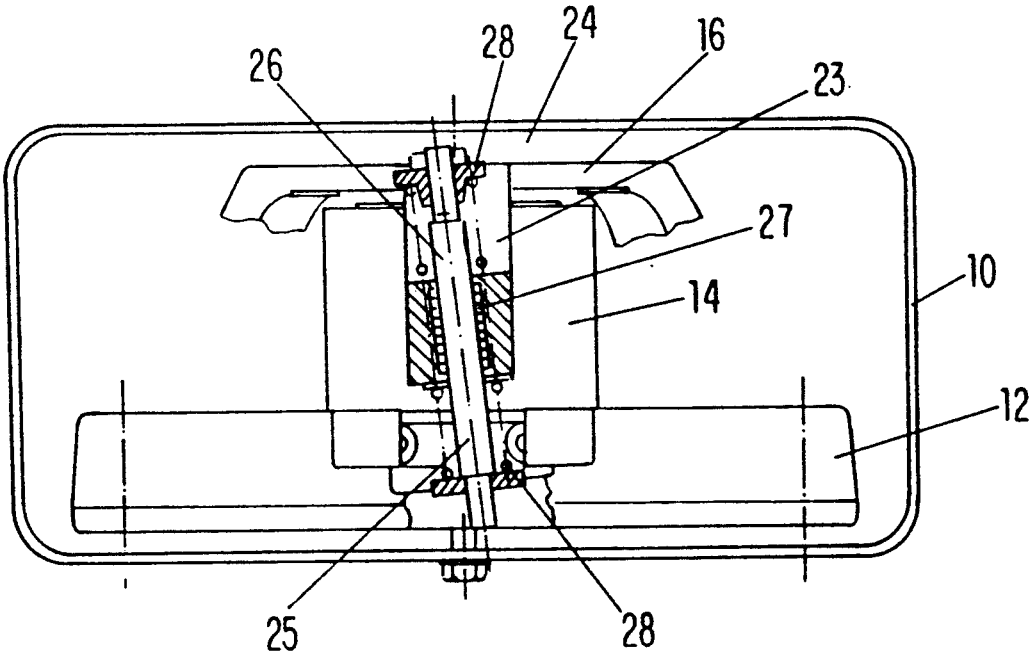
FIG. 3 shows on a larger scale a restraint guide of the screen carrier.

The spider 16 as part of the screen carrier 15 is guided with its three arms 23 on guides 24, arranged at the outer periphery of the base 12 and enclosing the electromagnet 14. The axes 25 of the guides 24 are tangentially inclined to the vertical axis of the screening machine (FIG. 3). Each guide 24 consists of a bolt 26, anchored in an inclined position at the base 12, on which a spherical roller sleeve 27 is slidable with freedom of play. The sleeve is firmly connected to the associated arm 23 of the spider 16. Above and below each spherical roller sleeve 27 there is arranged a compression spring 28, so that the motion of the spider arm 23 in both directions of movement along the bolt 26 occurs against the force of both springs 28.

At the housing 10 a carrier 29 is arranged fast with the housing. The carrier 29 extends below the screen plate holder 17, on which an inductive displacement pickup 30 is arranged such that it detects the vertical oscillatory movements of the screen carrier 15 respectively of its holder 17. In the housing 10 there is located a control unit 31, which, on the one hand, is connected to the inductive displacement pickup 30 via a signal line 32 and, on the other hand, via line 34 to an optical display 33, that is attached to the outside of the housing, as well as via a line 35 to the supply of energy for the electromagnet 14.

For an analysis to be carried out with the screening machine the electromagnet 14 is excited with a predetermined frequency, so that this electromagnet 14 excites the spider 16 of the screen carrier 15, arranged above it, to oscillate. This vertical oscillation is transformed via the guide of the spider arms 23 along the inclined bolt 26 into a three-dimensional screening motion. Because of the guiding restraint of the screen carrier 15 at the bolts 26 the vertical amplitude of oscillation of the screen carrier can be accurately detected, without overlapping oscillations occurring which could also be amplified by an irregular loading of the screening machine with the material being screened. This vertical amplitude of oscillation of the screen carrier is measured by the inductive displacement pickup 30, arranged fast with the housing, which transmits its signals via the signal line 32 to the control unit 31, in which the actual value for the amplitude of oscillation is detected and supplied via the signal line 34 to the optical display 33, so that in an analogous form the amplitude of oscillation measured according to the physical law can be read accurately by the operator.

The control unit 31 is also connected via the control line 35 to the supply of energy for the electromagnet 14, so that an amplitude of oscillation may be input via the display 33 and the control unit 31, by comparing the predetermined amplitude of oscillation with the measured values detected by the inductive displacement pickup 30, can control the driving energy for the electromagnet 14 until, in dependence on the particular assembly of screen plates in the screening machine, the predetermined amplitude of oscillation is accurately obtained.

In this way the analysis conditions may be established relative to the amplitude of oscillation without question, but also a reproducibility of the analysis conditions with the screening machine according to the invention is given.

The present invention is, of course, in no way restricted to the specific disclosure of the specification and drawings, but also encompasses any modifications within the scope of the appended claims.

What I claim is:

1. A screening machine with a three-dimensional screening motion, comprising:

a screen carrier for at least one screen plate, said screen carrier being movable relative to a housing at which said screen carrier is supported by resilient means;

an electromagnetic drive device for moving said screen carrier;

an inductive displacement pickup disposed between said housing and said screen carrier for determining an amplitude of oscillation of said screen carrier; and an electronic control unit connected to said pickup, said control unit having an optical display for displaying a determined amplitude of oscillation and controlling said electromagnetic drive device for obtaining a desired amplitude of oscillation in response to the determined amplitude of oscillation.

2. A screening machine according to claim 1, wherein a restraint guide, free from play, for said screen carrier is provided whereby said restraint guide controls a motion of said screen carrier relative to said housing.

3. A screening machine according to claim 2, wherein said screen carrier is slidably guided along a bolt arrangement attached fast to said housing.

4. A screening machine according to claim 3, wherein said restraint guide for said screen carrier is formed as a spherical roller sleeve arrangement connected to said screen carrier and embracing said bolt arrangement.

* * * * *